United States Patent [19]

Fermeglia et al.

[11] 4,371,284

[45] Feb. 1, 1983

[54] BARRIER EXTENSION ADAPTER

[76] Inventors: Gildo Fermeglia, c/o George Spector, 3615 Woolworth Bldg., 233 Broadway; George Spector, 3615 Woolworth Bldg., 233 Broadway, both of New York, N.Y. 10007

[21] Appl. No.: 178,506

[22] Filed: Aug. 15, 1980

[51] Int. Cl.[3] ..... F16B 3/04; F16B 21/00

[52] U.S. Cl. ..... 403/301; 403/287

[58] Field of Search ..... 404/6; 256/1, 13.1; 403/378, 330, 322, 317, 316, 301, 287; 40/607; 49/141, 334

[56] References Cited

U.S. PATENT DOCUMENTS

| | | | |
|---|---|---|---|
| 876,166 | 1/1908 | Gard | 49/334 |
| 1,979,369 | 11/1934 | Cushing et al. | 49/334 |
| 1,985,958 | 1/1935 | Staley | 49/334 |
| 3,791,072 | 2/1974 | Miller | 49/141 |
| 3,877,174 | 4/1975 | McDonald | 49/334 |
| 4,070,013 | 1/1978 | Sickler | 403/317 |

FOREIGN PATENT DOCUMENTS

| | | | |
|---|---|---|---|
| 2325966 | 12/1973 | Fed. Rep. of Germany | 404/6 |
| 2513275 | 7/1976 | Fed. Rep. of Germany | 404/6 |
| 564652 | 7/1975 | Switzerland | 404/6 |

*Primary Examiner*—Nile C. Byers, Jr.

[57] ABSTRACT

An adapter for an end of a traffic control barrier arm so that the arm may be extended in length, the adapter including a generally channel-shaped sleeve which at one end fits around the traffic control barrier arm and is bolted thereto while the other end of the sleeve has a board slided therein and secured in position by means of a spur supported on the sleeve and which digs into the board for a firm hold thereof.

3 Claims, 4 Drawing Figures

10
11
12
13
14
15
16
17
18
19
20
21
22
23
24
26
27
28
29
30
31
32
33
34
35
36
37
38
39
40
41
4

BARRIER EXTENSION ADAPTER

It is well known to those acquainted with the particular field, that automobile traffic barriers such as are used at toll gates, properly entrances, and other places are sometimes broken when an automobile accidently or willfully crashes therethrough, so that the arm of the barrier must be replaced. Such barrier may comprise just a horizontal arm supported at each end on sawhorse legs, or it may be an arm pivotally supported at one end from a stationary stanchion so that it can be horizontal when restricting traffic and which is upwardly tipped when allowing a traffic to pass by underneath. Replacing such broken off arms is time consuming.

A principal object of the present invention, accordingly is to provide an adapter between a stanchion and an arm, so that if the arm is broken off, the remaining arm stump is quickly and easily removed, and a new barrier arm readily replaces it.

Another object is to provide a barrier extension adapter which requires no tools to make the repair of the broken barrier.

Figures 1, 2, 3, 4:
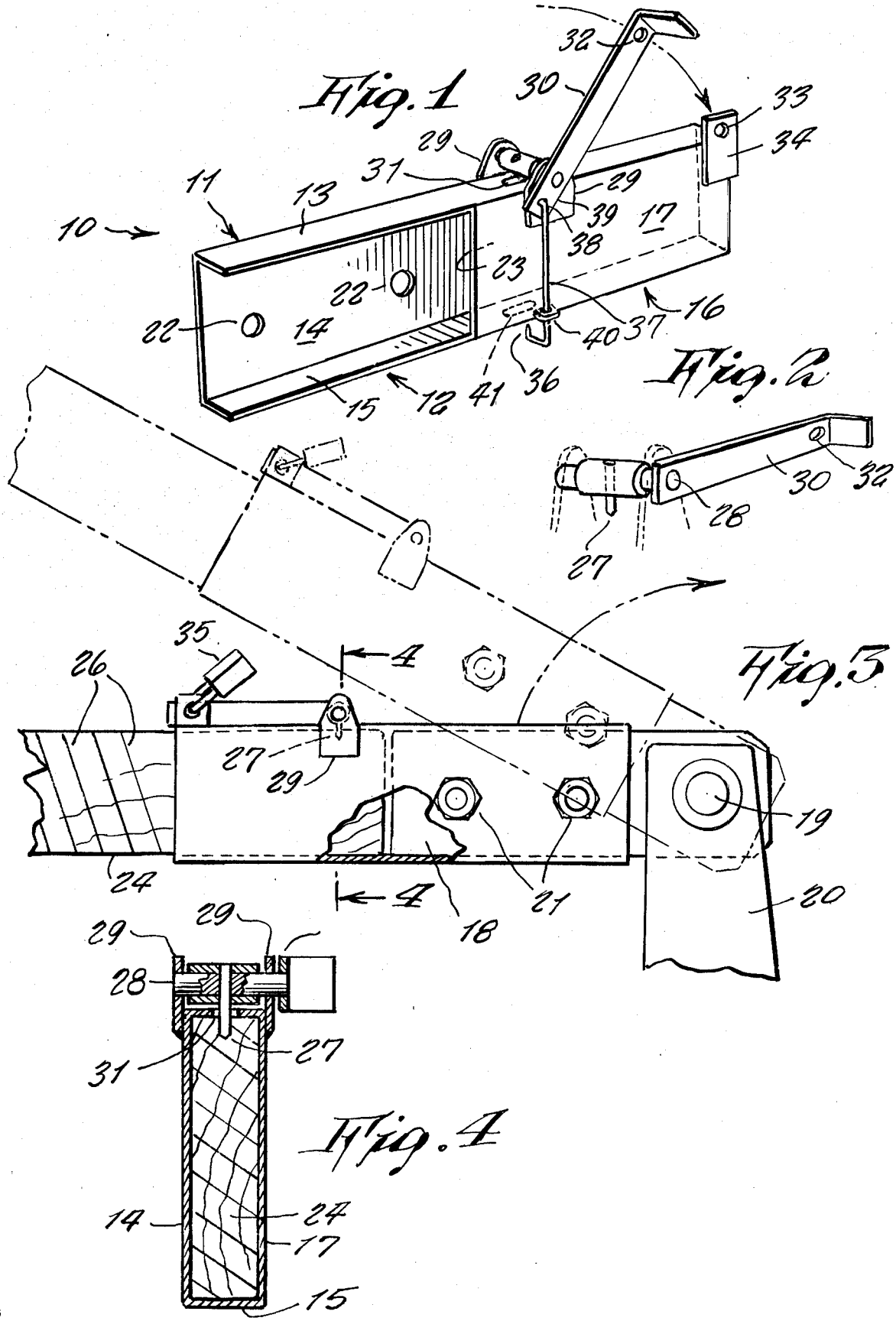
FIG. 1 is a perspective view of one design of the adapter wherein the arm extension is clamped between an upper and lower spur.
FIG. 2 is a perspective view of a modified design of a clamping arm wherein an arm extension is clamped only by an upper spur.
FIG. 3 is a side view of the present invention installed between a stanchion and an extension arm.
FIG. 4 is an enlarged cross sectional view taken on line 4—4 of FIG. 3.

Referring now to the drawing in greater detail, the reference numeral 10 represents a barrier extension adapter according to the present invention, wherein there is an elongated sleeve 11 made of strong steel, and which at one end 12 is a cross sectionally channel shaped by including three sides 13, 14 and 15, and while the other end 16 thereof is cross sectionally rectangularly tubular shaped by including the three sides 13, 14 and 15 and also a fourth side 17. The channel shaped end 12 fits around a short arm 18 made of a strong material such as steel so as to not readily break, the arm being pivotable about a pivot pin 19 supported on a stationary stanchion 20. A pair of bolts 21 through 22 of the adapter and corresponding holes in the arm rigidly secure the adapter on the arm.

The opposite end 16 of the sleeve forms a rectangular opening 23 into which one end of an elongated wooden board is inserted up to the arm, so as to form a barrier extension 24. The outer portion 25 of the extension may be painted with stripes 26 so as to be easily visible to automotive traffic.

The extension 24 is rigidly secured in the adapter by means while allow quick and easy replacement of the extension if broken. This securement means comprises a steel pin or spur 27 that digs into an upper edge of the extension. The spur 27 extends radially from a shaft 28 journalled in brackets 29 welded on the sleeve, the shaft being affixed to a handle 30, so that when the handle is pivoted, the spur swings down through a slot 31 in upper side 13 of the sleeve so as to dig into the wooden extension.

A hole 32 on the handle aligns with a hole 33 on a bracket 34 welded on the sleeve so as to receive a padlock 35 and thus prevent unauthorized persons to remove the extension from the adapter.

In one design of the invention shown in FIG. 1, an additional spur 36 digs into an underside side of the extension at a same time as the upper spur 27 when the handle is pivoted into the padlocking position. In this design, the handle includes a stiff rod 37 pivotally supported in a hole 38 on an extending end 39 thereof, the rod depending downward through a guide bracket 40 affixed on the sleeve, and a lower end of the rod being upwardly turned so to form the spur 36 which is inserted through a slot 41 in bottom side 15 of the sleeve and into the extension.

While various changes may be made in the detail construction, it is understood that such changes will be within the spirit and scope of the present invention as is defined by the appended claims.

What is claimed:

1. A barrier extension adapter, comprising a sleeve with aligned inner and outer ends, in combination with a pivotable arm of a stanchion bolted in said inner end of said sleeve, and an adjustable barrier extension adjustably inserted in said outer end of said sleeve in further combination with spur means for securement of said extension mounted on said outer end, said spur means including a pivotable latch whereby pivotable movement of said latch to a secured position drives a spur into said barrier extension.

2. The combination as set forth in claim 1, wherein said spur means comprises a spur radially extending from a shaft which is attached to said latch, said sleeve having a hole aligned with said spur whereby latch closure drives said spur into the hole.

3. The combination as set forth in claim 2, wherein said spur means further comprises a second spur attached to said latch by means of a rod extending to location spaced from said hole wherein the second said spur is directed opposite the first said spur whereby latch closure drives both spurs into said extension.

* * * * *